United States Patent [19]

Buttironi

[11] 4,337,013

[45] Jun. 29, 1982

[54] PLANT WITH MOBILE PLATFORMS FOR PARKING MOTOR VEHICLES OR THE LIKE

[75] Inventor: Giovanni Buttironi, Bergamo, Italy

[73] Assignee: AU.RO S.r.l, Bergamo, Italy

[21] Appl. No.: 47,105

[22] Filed: Jun. 11, 1979

[30] Foreign Application Priority Data

Jun. 15, 1978 [IT] Italy ..... 24599 A/78

[51] Int. Cl.[3] ..... E04H 6/06

[52] U.S. Cl. ..... 414/240; 104/48

[58] Field of Search ..... 414/22.7, 233–236, 414/239–241, 262, 264, 267, 277, 279, 284; 104/48, 50

[56] References Cited

U.S. PATENT DOCUMENTS 2,223,962 12/1940 Mitchell ..... 414/240

3,746,191 7/1973 Bianca ..... 414/240

*Primary Examiner*—Robert G. Sheridan

*Attorney, Agent, or Firm*—Burns, Doane, Swecker & Mathis

[57] ABSTRACT

A plant for storing motor vehicles onto mobile platforms, with a parking area comprising at least one long parking stretch and a service track parallel thereto; a motored travelling wagon, mobile along said service track; a plurality of parking places in said parking stretch, each being provided with a stationing track perpendicular to the service track; a plurality of platforms carrying the motor vehicles and being apt to slide on said stationing tracks and on said travelling wagon; a carriage with hook, which is associated with and slidable onto the travelling wagon, for hitching a platform and transferring it from the stationing track onto the wagon itself, or vice versa, from the wagon towards the stationing track.

14 Claims, 7 Drawing Figures

PLANT WITH MOBILE PLATFORMS FOR PARKING MOTOR VEHICLES OR THE LIKE

BACKGROUND OF THE INVENTION

It is known that there are at present various types of plants for parking motor vehicles—or, more generally, for storing pallets—wherein the motor vehicles, instead of being allowed to circulate on their own along access ramps up to the parking areas, are placed onto a parking platform, in correspondence of an inlet area, said platform being then shifted—automatically and along a set course—towards the parking area and being replaced by another platform in correspondence of the inlet area.

DESCRIPTION OF THE PRIOR ART

In general, the basic scheme of these plants which mobile platforms—whether they are built in the open air or, more often, underground—comprises two parallel, adjacent, rectilinear tracks, preferably horizontal and arranged one above the other, and means for moving forward the platforms along said tracks in opposed directions and for transferring them, at the ends of the tracks, from one track to the other.

According to one of the most known techniques, the platforms are tied one to the other, in succession, by a pair of chains with closed circuit, having both the function of dragging and guiding said platforms along said rectilinear tracks, and the function of supporting them during their transfer from one track to the other.

According to a further technique—described also in the Italian patents N. 532.983 and N. 907.540, in the name of the same Applicant—the platforms move along the rectilinear tracks simply coupled one to the other in a free manner, while at the two ends of the tracks they are released and transferred, one at a time, from one track to the other, by a pair of rotating arms.

These types of plants, though having proved to be very efficient, are however subject to some limitations which do not make it possible or convenient to use them in each case.

Above all, these types of plants have structures which are specially fit for parking areas of large dimensions, or in which it is essential to take advantage of a space in height, but they are not equally fit for more modest parking areas, as used, for example, for serving a single building, in that:

the powers installed, which would be modest for the mere motion of the platforms in the horizontal direction, would become high in relation to the means for transfering vertically the platform from one track to the other, the most complex structural part of the plant is that relating to the transfer means at the ends of the horizontal tracks, and consequently, the costs for construction and maintenance of the plant—inasmuch as being essentially determined by the transfer means—are justified from the economical point of view only if they are distributed over a sufficiently large number of parked motor vehicles, that is, over a plant of large dimensions.

SUMMARY OF THE INVENTION

The object of the present invention is a plant mainly designed for the parking of motor vehicles—but apt to be used for storing articles in general—intended to eliminate the heretofore mentioned drawbacks and, in particular, due to its very simple and economical structure and to the low power installed, being apt to solve very well the problem of realizing parking areas even of modest dimensions.

A further object of the present invention is to provide a plant apt to be arranged also in pillared spaces—as could be the basements of a building or in general the spaces obtained under areas of road traffic—without the supporting pillars hampering the movement of the platforms.

Another object of the present invention is to provide a plant wherein, each time, only the platform concerned is set in motion—without this motion involving the other platforms, as it occurs in all the heretofore mentioned plants of prior art—with obvious considerable reduction in the plant running costs.

All these objects are obtained with the plant according to the present invention which is essentially characterized in that, onto a parking area comprising at least a long parking stretch and a parallel service corridor to the side of said parking stretch, there are provided:

a service track, running along said service corridor, a motored travelling wagon, mobile along said service track, a plurality of parking places in said parking stretch, each being provided with a stationing track with axis transversal to that of said service track, a plurality of platforms sliding on said stationing tracks, as well as on said travelling wagon, and transfer means, associated to said travelling wagon, for transferring said mobile platforms, each from the respective stationing track onto the actual travelling wagon, or viceversa from the wagon towards the respective stationing track.

BRIEF DESCRIPTION OF THE DRAWINGS

Further characteristics and advantages of the plant according to the present invention will anyhow result evident from the following description of a preferred embodiment thereof, given however by mere way of example and illustrated in the accompanying drawings, in which.

DESCRIPTION OF THE PREFERRED EMBODIMENT

Figure 1:
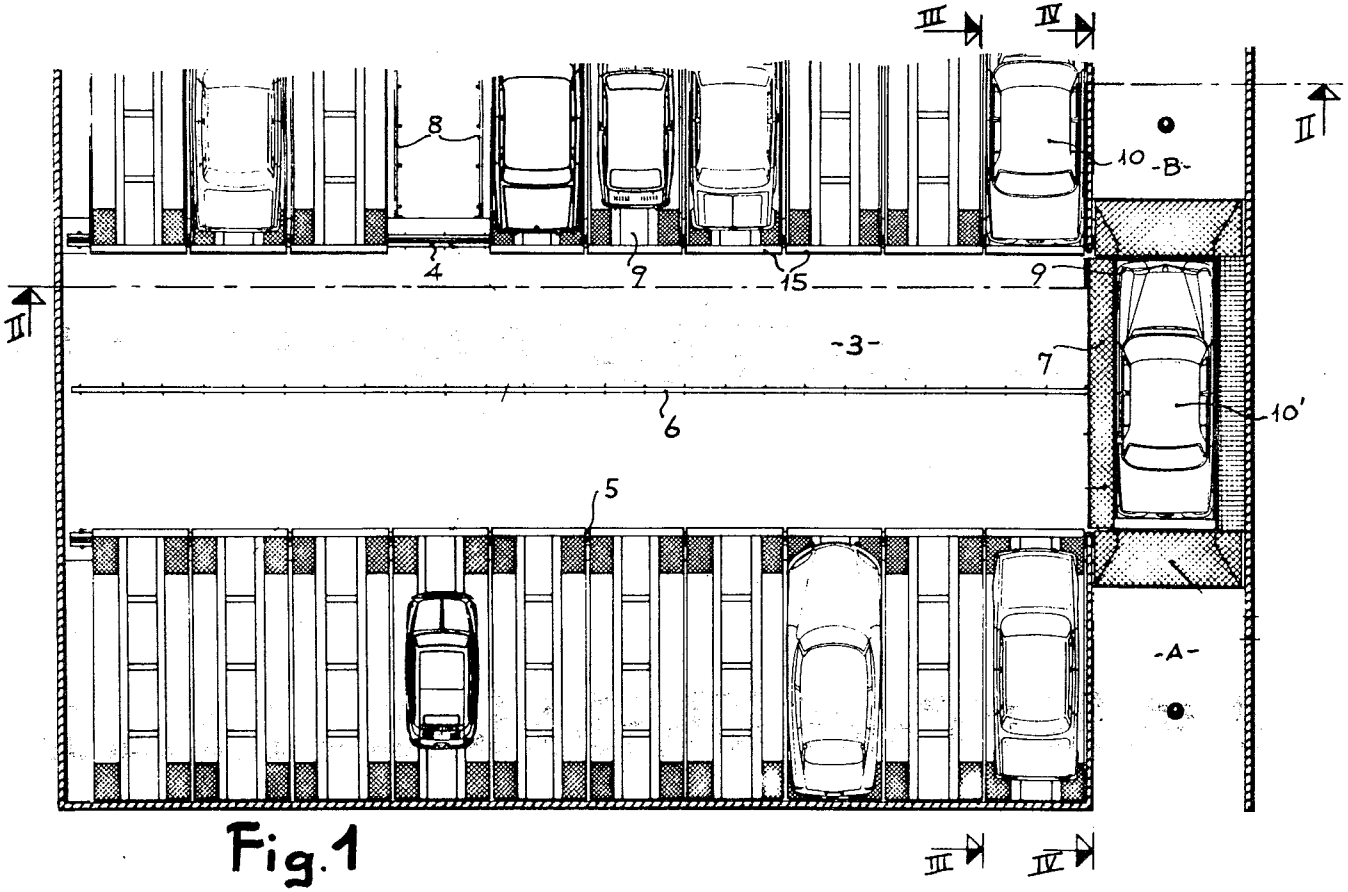
FIG. 1 is a general schematic plan view of a plant according to the invention.
Figure 2:
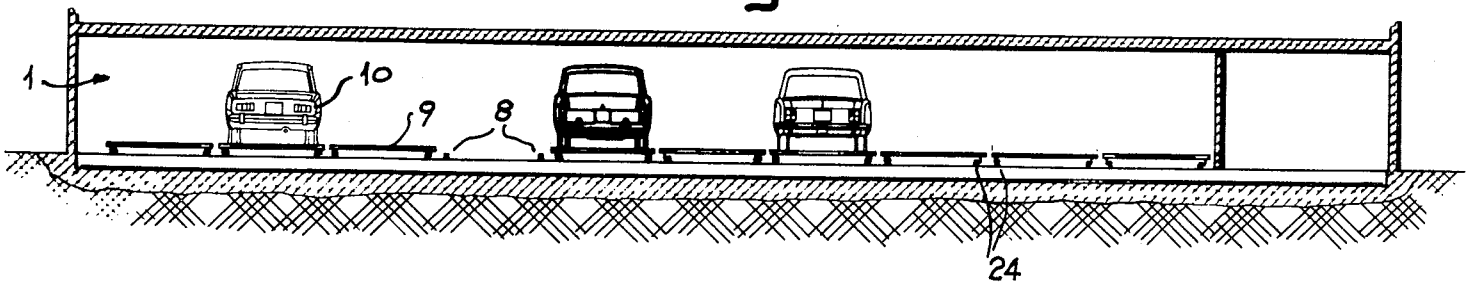
FIGS. 2, 3 and 4 are schematic vertical section views of the plant of FIG. 1, along the lines II—II, III—III and IV—IV.

As shown in FIG. 1, the plant comprises two parking stretches, indicated on the whole by 1 and 2, being separated by a longitudinal service corridor 3.

The corridor 3 contains a longitudinal track comprising two main side rails 4 and 5 and possibly a third central rail 6, as will be better described hereinafter.

Onto the track 4-5-6 slides the travelling wagon 7, which is caused to advance by motor means of its own and which is operated by a position control system. This control system—which may be electric and/or electronic, pneumatic, or simply mechanical—will not be described hereinafter, as it is a system known per se and which anyhow departs from the scope of the present invention.

The parking stretches 1 and 2 are divided into a plurality of parking places, each being defined by a stationing track section 8, the axis of which is transversal to the service track 4-5-6. Onto each track 8 there slides, by means of idle wheels of its own, a platform 9 for the parking of a motor vehicle 10.

Through the respective driving and control means, the travelling wagon 7 moves from the zone of access A-B to the parking area, up to stopping in correspondence of a preselected parking place. In this position—through the aforespecified transfer means, described in detail hereinafter—the preselected platform is transferred onto the wagon 7. Then the wagon 7 moves back to the zone of access A-B: in this zone, the motor vehicle 10' which enters from A, can get onto the platform 9, carried by the wagon 7, and this latter can carry the platform back to the parking place left free. Or vice-versa, the motor vehicle 10' which was already stationed on the platform 9, can get off it and leave from B.

Figure 3:
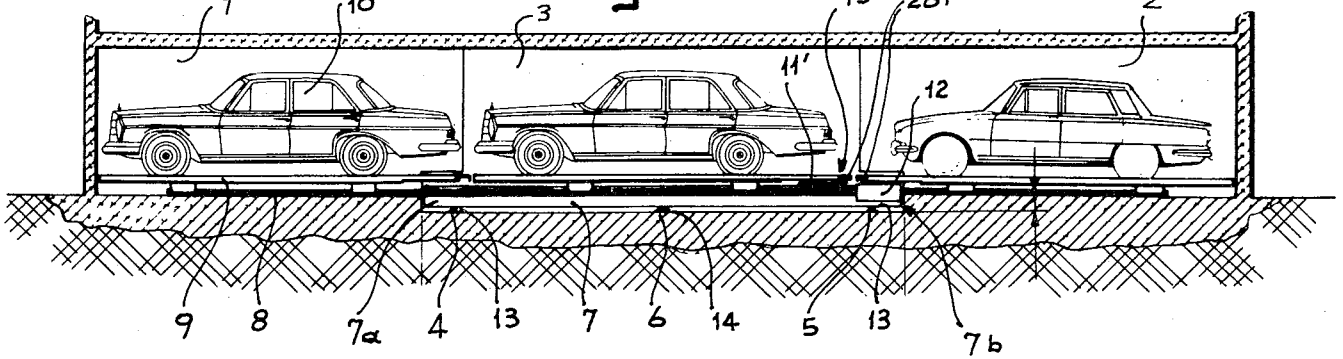
Figure 4:
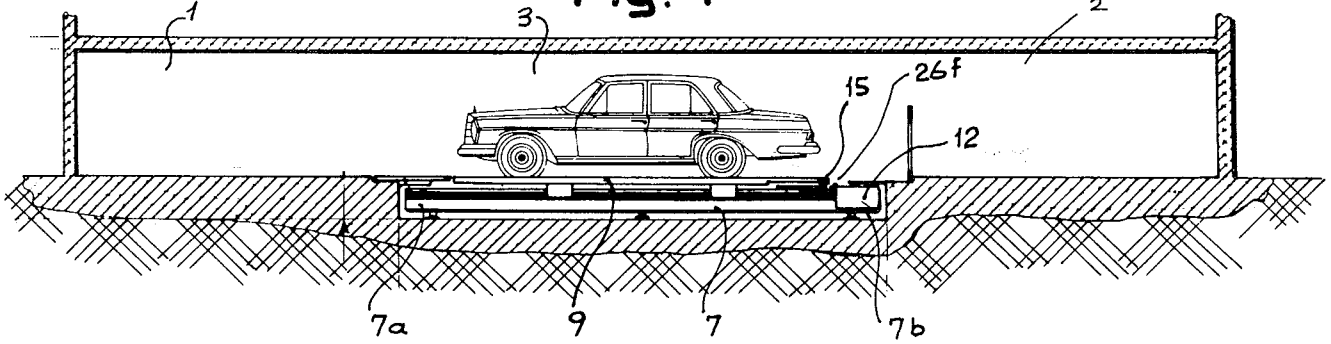
Figure 5:
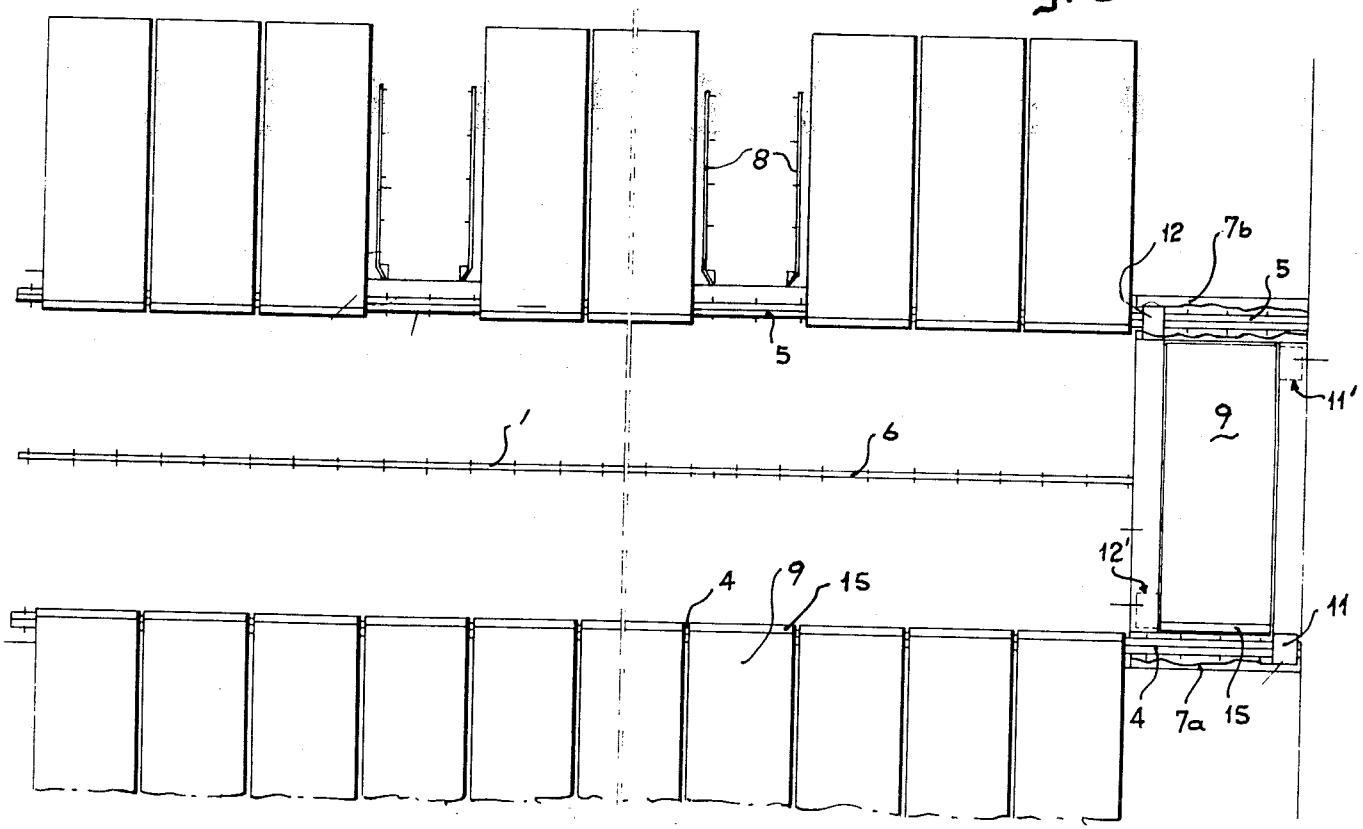
FIG. 5 is a partial schematic plan view of the same plant, showing in particular the travelling wagon in the zone of access to the parking area.
Figure 6:
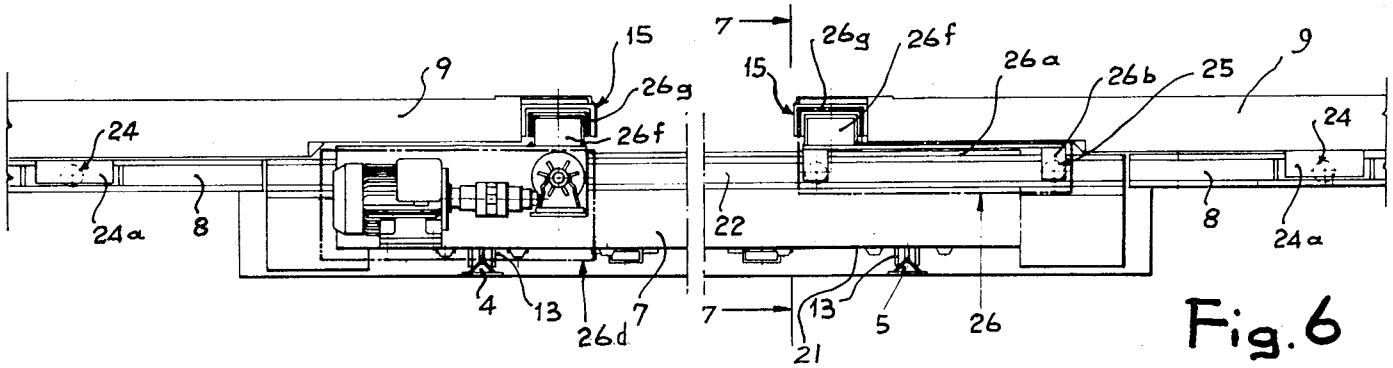
FIG. 6 is a schematic longitudinal section view of the travelling wagon, on an enlarged scale.
Figure 7:
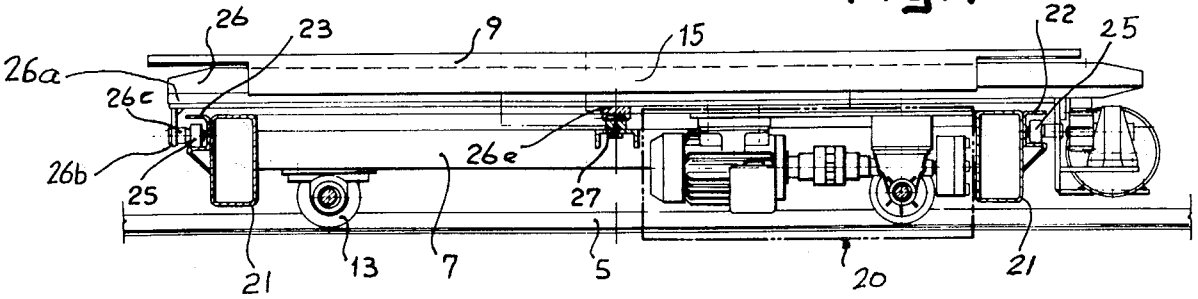
FIG. 7 is a schematic cross section view of the same wagon substantially along the line 7—7 of FIG. 6.

The general structure of the travelling wagon 7 can already be seen in FIGS. 3, 4 and 5, while some details thereof are shown in FIGS. 6 and 7.

As shown, the wagon 7 is—in the direction transversal to the track 4-5-6—longer than the platforms 9, so that it comprises two end parts 7*a* and 7*b* which project beyond the ends of the platform carried by the wagon itself. In such end parts 7*a* and 7*b* are normally housed the transfer means 11 and 12, in the form of self-propelled carriages (better illustrated hereinafter).

The wagon 7 bears, at its opposite ends, onto the rails 4 and 5 by means of wheels 13. Preferably, and as shown in FIG. 6, the rails 4, 5, have a triangular section and the wheels 13 have a bearing groove which has in turn a triangular profile: this arrangement guarantees in fact, at the same time, a perfect transversal positioning of the wagon and a proper adherence of the wheels—particularly the driving wheels—onto the track.

When the wagon 7 is particularly long—as always happens when the plant is designed for housing any type of motor vehicle, without limitations of length—it is generally appropriate to provide for a third, central rail, onto which the wagon bears with at least one central idle wheel 14, usually flat (not better shown). This arrangement allows to keep the carrying structure of the wagon 7 sufficiently light and slender—even for the transport of particularly heavy vehicles—limiting however the deflection of the structure.

It should be noted, in this connection, that even if the six-wheels system appears as a hyperstatic system, it is however possible to always guarantee a regular bearing by making use of the deflection at the centre—actually deriving from this slender and flexible structure of the wagon—to cause the actual bearing of the central wheel. On the other hand, in addition to the advantage from the point of view of lightness and cost, said slender structure allows to keep the vertical dimensions of the wagon within very modest limits, with obvious structural advantages.

The structure of the mobile platforms is extremely simple, in that it is formed by a rigid flatcar mounted on idle wheels.

The essential characteristic of such platforms, for the purposes of the present invention, lies in the fact that they terminate—at their end facing the service corridor—with a large U-shaped overturned channel 15, arranged parallel to the longitudinal axis of the track 4-5-6. When the platforms are correctly positioned in the respective parking places, all the channels 15 are on the same alignment.

Some details of the platforms 9 and of the wagon 7 can be seen better in FIGS. 6 and 7.

For what concerns the wagon 7, FIG. 7 shows the motor unit 20, placed under the flatcar, in the axle base of the wheels 13. The motor 20 is designed to drive preferably a single pair of wheels, both in one running direction and in the opposite direction.

FIG. 7 also shows the main frame members 21 of the wagon 7, to the sides of which are provided the slide guides 22, 23, for the wheels 24 of the platform 9, said slide guides being therefore set perpendicularly to the track 4-5-6, as better specified hereinafter. The guides 22, 23, are formed by C-shaped channel sections, open towards the outer side of the wagon, or even by closed U-shaped channel sections, for the purpose better specified hereinafter.

The cited means 11, 12, for transfer of the platform, each consist of a carriage 26 associated to the wagon 7 and provided with wheels 25 which slide in the guides 22, 23. Each carriage 26 is essentially formed by a horizontal plate 26*a*, at the ends of which are fixed the brackets 26*b* carrying the pins 26*c* of the wheels 25, mounted cantilevered and facing the inside of the wagon 7.

Fixed laterally and beneath each carriage 26, are provided motor means 26*d*, leading into rotation—through a shaft of appropriate length (not shown)—a pinion gear 26*e* which meshes with a rack 27, fixed to the frame of the wagon 7 and running along its full length. Through appropriate operation of said motor means and thanks to the engagement of the pinion 26*e* with the rack 27, the carriage 26 is shifted, forward or backward, onto the wagon 7.

Above the plate 26*a* of the carriage 26 is fixed a large tooth 26*f*, which may be formed by:

a simple pin, designed to engage from the bottom into the aforecited U-shaped overturned channel 15, associated to the platform 9. In this case, the pin forming the tooth 26*f* will preferably carry on its upper end a bearing 26*g*, designed to facilitate the sliding into the channel 15, as specified hereinafter; or a square bar or section, welded onto the plate 26*a* parallely to the said channel 15 and having beveled ends to equally facilitate the engagement into said channel 15 of the platform.

Alternatively, the ends of each channel 15 may be beveled, to facilitate the introduction of the tooth 26*f* during sliding of the wagon 7 along the track 4-5-6, as better specified hereinafter.

Like the wheels 25 of the carriages 26, also the wheels 24 of the platforms 9 are mounted on pins fixed cantilevered and facing the inside of the platform, said pins being carried by brackets 24*a* projecting downwards from the platform flatcar. This arrangement allows to keep the transversal dimensions of the platforms within the size of the flatcar actually required for stationing the motor vehicles, that is, without the wheels forming an additional transversal bulk.

This arrangement also allows to make use of slide guides 22, 23, with a C-shaped section—as said—which have the advantage of providing, not only a transversal guide with a minimum slack, but also a double guide in the vertical direction; in other words, the guides 22 and 23 do not only support the platform wheels 24 and the carriage wheels 25 together with the weight carried thereby, but they are also apt to keep said wheels from shifting upwards. By this precaution, it is thus possible to form the platforms with remarkable end projecting parts, providing for the wheels 24 to be placed in such a position as to have the same deflection both on the axle base and on the projecting part. By reducing the length of the axle base, one has the advantage of being able to construct the frame of the platforms with structural components of smaller section and consequently lighter and thinner, therefore less costly and less heavy and cumbersome. It should not be feared however that, due to the high overhang, a turnover of the platform may take place in some loading conditions, since—as said—the platform is restrained by the bearing of its wheels 24 against the upper flange of the guides 22, 23.

As already stated, instead of using C-shaped guides 22, 23, it is possible to use closed U-shaped guides, provided that the brackets 24*a* of the wheels 24 and the brackets 26*b* of the wheels 25 are suitably shaped.

To complete what has already been said heretofore, the operation of the plant comprises the following stages:

when the wagon 7 slides onto the track 4-5-6, either to go and collect a platform from its parking place, or to carry it back, it moves with its end parts 7*a* and 7*b* sliding beneath the ends of the parked platforms 9. For this purpose—and as clearly shown in FIGS. 3 and 4—the platforms 9, parked on the respective stationary tracks 8, considerably project, with their ends carrying the overturned channels 15, above the lateral edges of the service corridor 3 and over the actual rails 4 and 5;

during this sliding, the teeth 26*f* of the carriages 26 freely slide into the succession of channels 15. In this way, when the wagon 7 stops in front of a parking place to collect the platform therefrom, its tooth 26*f* is already engaged into the channel 15;

for the transfer of a preselected platform 9 from the respective parking place onto the wagon 7, the carriage 11 or 12—which is at that moment in a rest position, with its tooth 26*f* engaged into the channel 15 of the platform—is moved towards the position 11', or respectively 12', dragging thereby the platform itself onto the wagon;

when the platform 9 is on the wagon 7—either with the vehicle 10 parked thereon, or without vehicle—the wagon 7 freely moves along the track 4-5-6, in that the ends of said platform do not interfere with the ends of the other platforms stationed in the respective parking places, as clearly shown in FIG. 3;

the return of the platform into its parking place takes place in a manner opposite to that described for its transfer onto the wagon. After the wagon 7 has moved to stop in front of the empty parking place, in alignment with the relative stationing track 8, the transfer carriage, for instance the carriage being in the position 11' in FIG. 3, is carried back to its rest position 11 by pushing—always thanks to the engagement of its tooth 26*f* into the channel 15—the platform 9 towards its stationing track 8. This movement is facilitated by the fact that—according to an additional characteristic of the present invention—all the tracks 8 are slightly inclined and descending from the edge adjacent to the service corridor 3, towards the opposed end: this not only facilitates the entry of the platform into the parking place, but also its steady stationing onto said place.

As clearly results from the above, the plant according to the present invention is extremely simple from the structural and from the functional point of view. Through the usual control systems for the plants of this type, it is of course possible to make its working fully automatic; it should be noted, however, that in case of failure of the automatic control system, or even simply in case of lack of current, the plant does not remain out-of-work in that two men are sufficient to set in motion both the platforms 9 and the wagon 7 in emergency conditions.

In addition to being extremely simple from the structural and functional point of view, the plant according to the present invention is also remarkably flexible from the point of view of use. To start with, as already said, the single parking places may be arranged in a pillared area, without the presence of such pillars representing a real impediment: it is in fact sufficient, in correspondence of the pillars, to space the stationing tracks to an extent corresponding to the width of the actual pillars.

If required—according to the availability of space—it is even possible to use stationing platforms of different sizes: for instance of reduced length, for what concerns the platforms being stationed on one of the parking areas 1 or 2, or even of reduced width—though always with the same gauge between the wheels 24—when intending to use to the utmost the space available between the pillars.

Even the arrangement of the vehicles, that is of the platforms, with the major axis perpendicular to the service track—as in the embodiment heretofore described—is not binding, but it is also possible to provide an arrangement rotated by 90° in respect of the one described, or even an oblique arrangement if this allowed to satisfy particular requirements of adaption to the space available.

In addition to the cited flexibility of use—in the sense of fitness to adapt itself to pre-existing areas and structures—also the possibility of adapting itself to the most different uses should be placed in evidence. It is obvious, first of all, that the plant according to the invention may be used not only as parking area, but also as area for storing vehicles at factories, their branch offices or at dealers.

More generally, the plant according to the invention may be utilized as storing area for any other type of wares, also by using—associated to the platforms, or in replacement thereof—box or cradle containers, or the like:

both for setting up a true and proper warehouse, for example for storing packages of any type, pallets, containers (also for fragile goods, as glassware, seeing that the motion takes place in an absolutely safe and smooth manner);

and for forming storage units for industrial production lines, wherein the different pieces (car bodies, washing machines, refrigerators and the like, mechanical and electrical parts, intermediate forgings and semi-finished products) may be housed on the platforms, both singly and in more pieces, and even in bulk.

Finally, though the plant according to the invention is perfectly suited—as said at the beginning—for realizing parking areas of modest dimensions, it is however quite evident that, by its own nature, the plant itself does not suffer of any dimensional limitations, but it actually lends itself quite easily for being placed over large surfaces, even on various superimposed levels, obviously in combination with elevator means.

When the plant is particularly large, or any time that it were required for particular conditions of use, it is of course possible—within the scope of the present invention—to use also two independent travelling wagons, merely coordinated by the general control system in order to avoid collisions.

In any case, it should be well understood that the invention is not limited to the particular embodiment described—which is besides illustrated by mere way of example and hence very schematically—but that a great number of variants and improvements thereof may be provided, all aiming at making easier and safer the motion of the platforms, without thereby departing from the scope of the invention itself.

I claim:

1. Plant for storing units, particularly motor vehicles, onto mobile platforms over a storing or parking area having at least one long parking stretch and a parallel service corridor along a side of said parking stretch, comprising:

a service track running along said service corridor, at least one motored travelling wagon adapted for movement along said service track, a plurality of storing or parking places in said parking stretch, each place being provided with a stationing track with an axis transverse to the axis of the service track, a plurality of mobile platforms slidable both on said stationing tracks and on said travelling wagon, each of said platforms having an inverted U-shaped channel section extending in a direction parallel to the axis of the service track, the U-shaped channel sections are all substantially aligned on a common axis when the platforms are arranged on the stationing tracks, transfer means, associated with said travelling wagon, for transferring said mobile platforms from a respective stationing track onto the travelling wagon, or vice versa from the wagon towards the respective stationing track, said transfer means comprising at least one carriage movable along the travelling wagon in a direction parallel to said stationing tracks, and hook means fixed to said carriage for substantially continuously engaging at least one of the inverted U-shaped channel sections during movement of the travelling wagon along the service track, said hook means being adapted to move one platform onto the wagon from the respective stationing track, or vice versa, to push the platform off of the wagon towards the respective stationing track.

2. Plant as in claim 1, wherein said hook means fixed to the transfer carriage comprises a vertically projecting tooth adapted to engage the inverted U-shaped channel section.

3. Plant as in claim 2, wherein said projecting tooth is formed by a pin having a freely rotatable bearing mounted on an upper end.

4. Plant as in claim 2, wherein said projecting tooth is formed by a square bar or section fixed to the carriage itself such that two sides are parallel to said inverted U-shaped channel section attached to the platform, said square bar or section having beveled ends.

5. Plant as in claim 2, wherein said inverted U-shaped channel sections associated with the platforms have beveled ends.

6. Plant as in claim 1, wherein said service track comprises a pair of rails having an isosceles triangle section with upward apex.

7. Plant as in claim 1 or 6, wherein said service track comprises a pair of side rails and a flat central rail.

8. Plant as in claim 1, wherein said travelling wagon includes motor means for operating at least one pair of driving wheels.

9. Plant as in claim 6, wherein said travelling wagon includes motor means for operating at least one pair of driving wheels having a groove with triangular profile complementary to that of the rails.

10. Plant as in claim 1, wherein each of said platforms is supported by idle wheels, each wheel being rotatable about a pin projecting towards the inside of the platform, said pin being fixed to a bracket projecting downwards from the platform.

11. Plant as in claim 1 or 10, wherein said stationing tracks comprise a pair of rails formed by C-shaped sections open towards the outer side of the respective track.

12. Plant as in claim 1 or 10, further comprising two guides formed by C-shaped channel sections, said guides being open toward the outer side of the wagon and fixed to the sides of the travelling wagon parallel to the axis of said stationing tracks.

13. Plant as in claim 12, wherein said C-shaped guides are beveled at the ends to facilitate introduction of the platform idle wheels.

14. Plant as in claim 1, further comprising two long parking stretches arranged on either side of said service corridor, said at least one travelling wagon serving both of said parking stretches, said wagon having two independent transfer carriages slidably mounted thereon, each carriage being adapted to cooperate with the platforms placed on a single respective long parking stretch.

* * * * *